United States Patent [19]

Barlow

[11] 3,954,045

[45] May 4, 1976

[54] ROTARY ACTUATOR VALVE

[75] Inventor: Roland J. Barlow, Madison Heights, Mich.

[73] Assignee: Ex-Cell-O Corporation, Troy, Mich.

[22] Filed: Apr. 10, 1974

[21] Appl. No.: 459,495

[52] U.S. Cl. ..... 91/382; 91/387; 91/459

[51] Int. Cl.[2] ..... F15B 9/10; F15B 13/16; F15B 13/044

[58] Field of Search ..... 91/385, 386, 387, 382, 91/376 A

[56] References Cited

UNITED STATES PATENTS

| | | | |
|---|---|---|---|
| 1,638,102 | 8/1927 | Roucka | 91/387 |
| 2,053,797 | 9/1936 | King | 91/387 |
| 2,139,981 | 12/1938 | Sugihara | 91/387 |
| 2,291,048 | 7/1942 | Lichtenstein | 91/387 |
| 2,966,891 | 1/1961 | Williams | 91/387 |
| 3,101,031 | 8/1963 | Crossley, Jr. | 91/387 |
| 3,745,883 | 7/1973 | Ward | 91/386 |

*Primary Examiner*—Paul E. Maslousky
*Attorney, Agent, or Firm*—James H. Bower; Frank D. Risko

[57] ABSTRACT

A mechanical feedback controlled valve regulates the fluid flow into the vane or piston compartment for controlling the direction, position, velocity, acceleration and/or deceleration of the output shaft.

9 Claims, 9 Drawing Figures

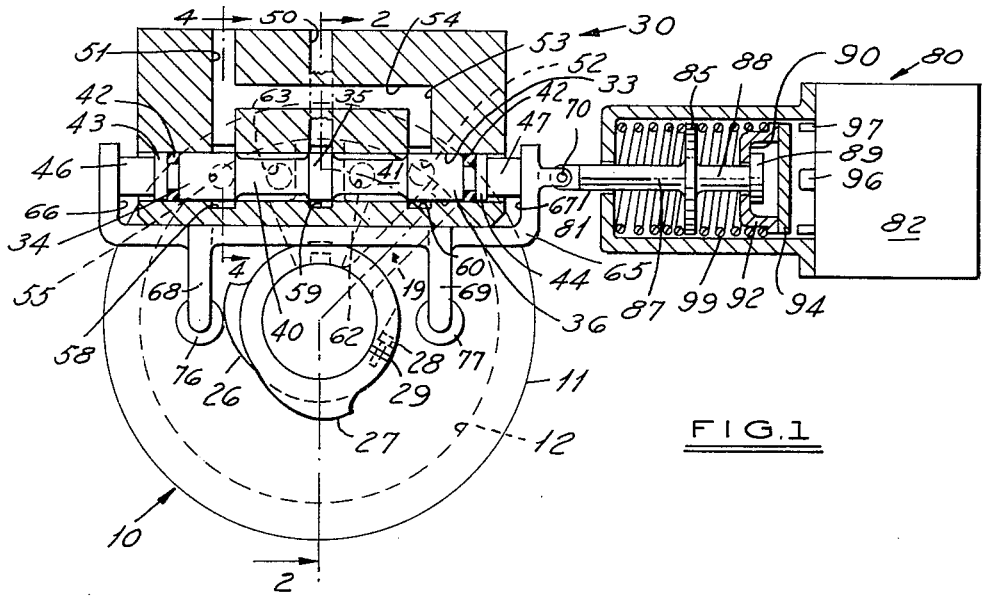
FIG. 1
FIG. 4
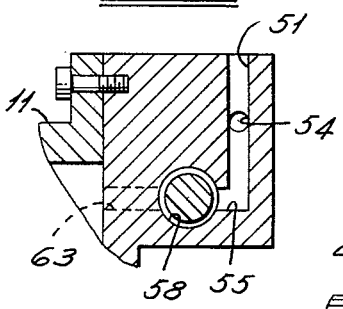
FIG. 2
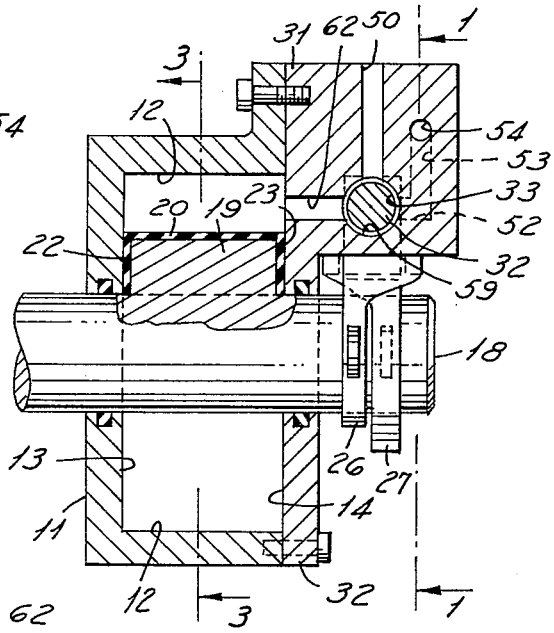
FIG. 3
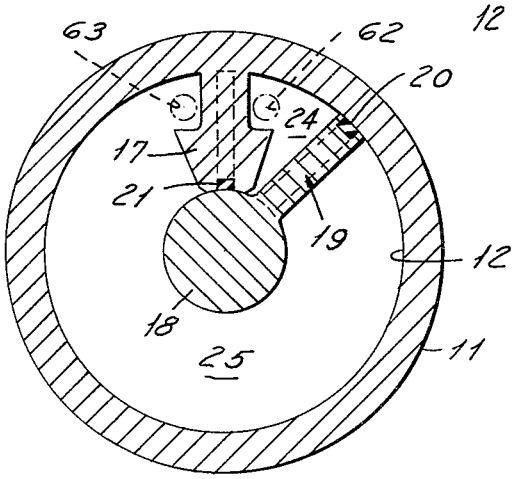
FIG. 9
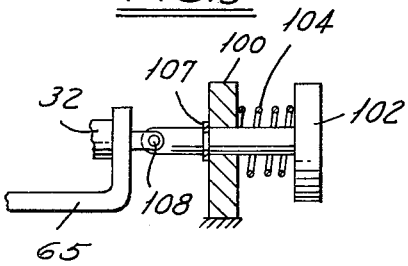

ROTARY ACTUATOR VALVE

BACKGROUND OF THE INVENTION

1. Field of the Invention

This invention relates to the controlling of the output shaft in a rotary actuator by a feedback means associated with a control valve which will determine the direction, position, velocity, acceleration and deceleration of the output shaft.

2. Description of Prior Art

It is well known and recognized in this art to use a proportional control servo valve for controlling the output displacement of a rotary actuator with regard to all of its motions. Many schemes employ a four-way solenoid valve or a proportional control servo valve. When a four-way valve is used, it is necessary to insert a deceleration valve in the hydraulic circuit which would prevent the vane in a rotary actuator from slamming against its mechanical stop. The proportional control servo valve, which is much more costly than a simple four-way valve, can be controlled by an electrical signal proportional to the rotary position of the shaft through an appropriate electrical feedback circuit which would slow the vane down and not allow it to slam into the stop. Also, the electrical signal could be varying in amplitude and frequency which could give velocity, acceleration, deceleration and position control to the output shaft.

SUMMARY OF THE INVENTION

This invention through the use of a four-way directional control valve can cause precise control of the direction, position, velocity and acceleration/deceleration of the output shaft of a rotary actuator. The directional control valve is controlled by an electrical solenoid which in conjunction with a following means controls the spool position of the valve with respect to the motions of the output shaft.

BRIEF DESCRIPTION OF THE DRAWINGS

FIG. 1 is a front view of the solenoid, valve block and spool sectioned and the rotary actuator.

FIG. 2 is a section through the center of the actuator and the valve.

FIG. 3 is a section showing the housing and shaft/vane combination.

FIG. 4 is a section showing return port and valve spool relationship.

FIG. 9 is a mechanical control means.

GENERAL DESCRIPTION

Figure 5:
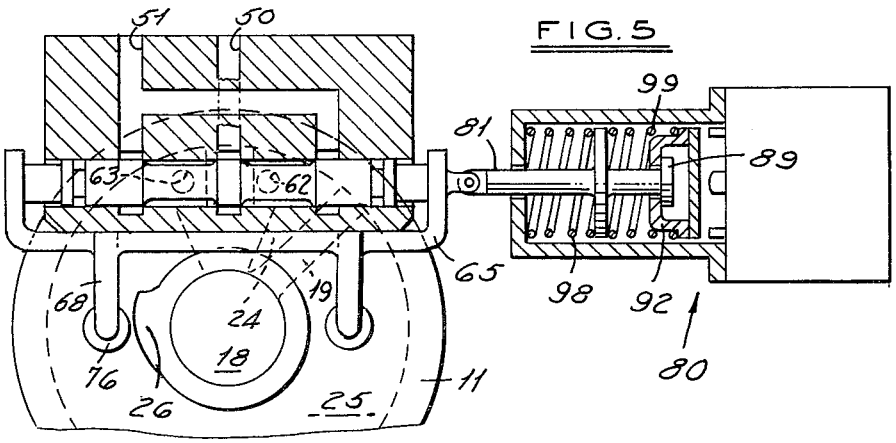
FIG. 5 is a partial section showing the solenoid deenergized and valve spool centered.

The object of this invention is to provide a mechanical feedback scheme which will move the control spool of a four-way valve integrated as part of an actuator assembly to achieve motion control of the output shaft. A further object is to control the spool movement by a unique spring solenoid device which allows the feedback to occur in proper timing relation to the shaft.

Referring now to the drawings for the purposes of illustrating a preferred embodiment of the invention and not for the purpose of limiting same, FIG. 1 shows a vane-type actuator assembly 10, valve assembly 30, and solenoid assembly 80. The vane-type actuator assembly 10 comprises generally a main housing member 11 having an arcuate surface 12, a rear surface 13, a front surface 14, and a mechanical stop 17. The shaft 18 and vane 19 comprise the rotating part of the device and have a surface seal 21 seen best in FIG. 3 which seals all four surfaces of the stop 17. The single piece seal made up of seals 22, 20 and 23 comprise the vane surface seal which seals against surfaces 13, 12 and 14 respectively and prevents fluid leakage between chamber 24 and 25. Details of this type seal are described in U.S. Pat. No. 2,902,009 and the seal is well known in the art. Cam 27 shown in FIG. 1 is adjustable on shaft 18 by clamp screw 28 which allows the cam to be positioned at any point around the shaft. This same type of adjustment exists on cam 26. Since both of the cams are adjustable, it is possible to have the rotation equalized in both directions or each direction can have a different angular movement. Mechanical stop 17 prevents vane 19 from making a full 360° rotation but, as will be seen, is necessary for the operation of this type device.

The valve assembly 30 consists of the valve body 31 which is shown in FIG. 2 integrally connected to cover plate 32 forming the front of the actuator assembly 10. The spool 32 in bore 33 consists of three cylindrical land surfaces 34, 35 and 36 connected by cylinders 40 and 41 with seals 42 at each end held in place by cylinders 43 and 44 which are connected to cylinders 46 and 47 respectively. This spool assembly 32 controls the flow of fluid from port 50 which intersects undercut annulus 59 that connects to bore 33. The return flow path shown in FIG. 4, depending on the operation, would be from bore 33 through undercut annulus 58 through bore 55 which intersects with return port 51. The other return path shown in FIG. 1 and 2 would be through undercut annulus 60 which intersects with bore 33 and connects to bore 52 which intersects with bore 53. Bore 53 is connected to return port 51 by cross bore 54. Bore 62 and 63 intersect bore 33 to provide fluid flow to chambers 24 and 25 respectively.

The cradle assembly 65 consists of a U-shaped section with surface 66 and 67 in contact with cylinder 46 and 47 respectively of control spool 32. Two legs 68 and 69 are connected to the U-shaped section and have cam follower means 76 and 77 pinned in each leg respectively. Cam follower 76 will engage cam 26 and follower 77 will engage cam 27. This cradle assembly 65 is affixed by pin 70 to shaft 81 of the solenoid assembly 80.

The solenoid assembly 80 consists of solenoid 82 and housing 83 which is affixed to solenoid 82 by some fastening means. Shaft 81 consists of a flange 85 connected to cylinders 87 and 88. Cap 89 is affixed to cylinder 88 which completes the shaft. A shroud 92 and disc 94 are shown integrally connected to form a spring retainer. The correct operation of this invention does allow them to be separate pieces. Pin 96 is the solenoid plunger. Springs 98 and 99 are preloaded inside housing 83 so that spring 99 will bear on flange 85 and shroud 92. Surface 90 on shroud 92 will stop against head 89 giving the maximum expansion and minimum force of spring 99. In the normal centered operating position, spring 98 is preloaded between housing 83 and flange 85 and in the preferred embodiment will have a slightly lower preload force than spring 99. However, both spring constants can be the same or spring 98 can be greater than 99. The main point is that the absolute spring constant of both is very low so the relative preload force change of the spring that occurs due to the motion of the shaft 81 is very small. This preload force is sufficient to overcome frictional forces in the cradle/spool system. Stop 97 is an annulus affixed to solenoid 82 which prevents overtravel of the shroud 92 and disc 94.

OPERATION

FIG. 5 shows the system at rest with spool 32 in mid-position having cylinder 35 centered with undercut annulus 59, thereby giving equal pressures into bores 62 and 63 which subsequently connect to volume chambers 24 and 25 respectively. The balance of pressures in these chambers prevents any force imbalance which could occur on vane 19. In this position, contact is maintained between cam 26 and follower 76 affixed to leg 68 of cradle assembly 65. At this time, solenoid assembly 80 is de-energized and springs 98 and 99 are expanded with spring retaining shroud 92 seated against cap 89.

Figure 6:
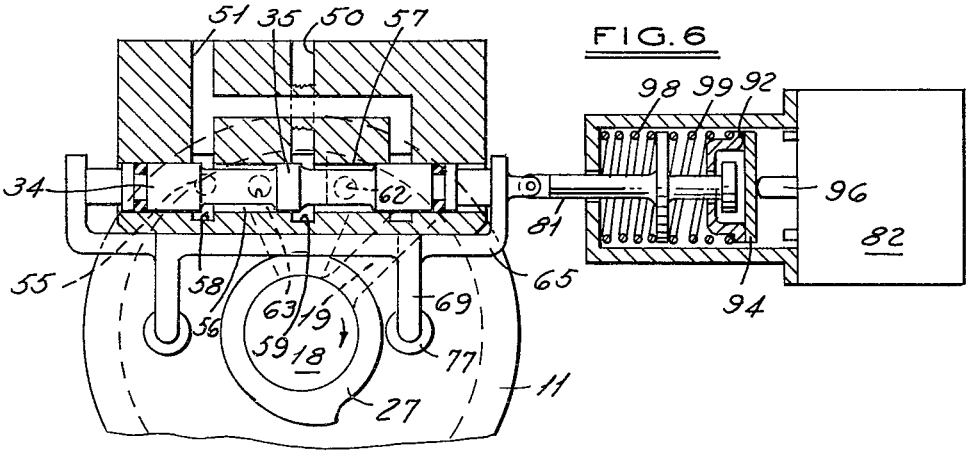
FIG. 6 is a partial section showing the solenoid energized and the spool off center at start of first cycle.
Figure 7:
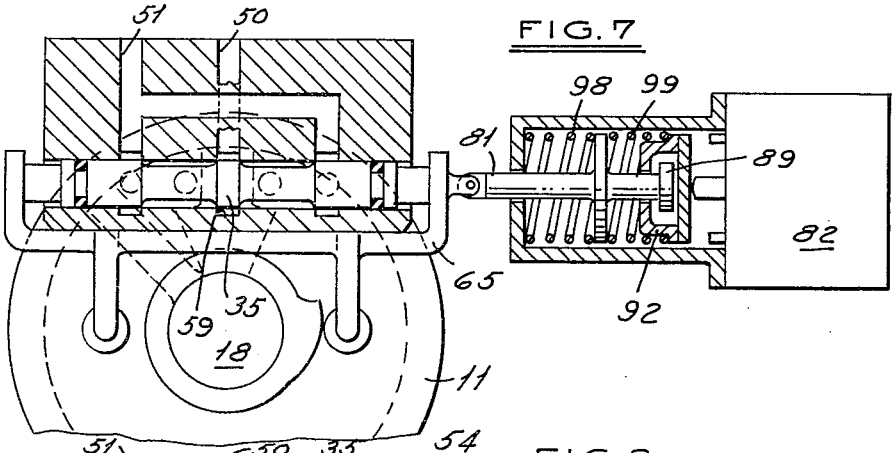
FIG. 7 is a partial section showing the solenoid energized and the spool recentered at end of a cycle.

FIG. 6 shows the solenoid 82 energized which moves pin 96 against disc 94 compressing spring 98. The compression or collapse of this spring now allows shaft 81 to move which is pinned to cradle assembly 65 which in turn is moved to the left. Depending on the relative preload force of springs 98 and 99, different actions will occur. If spring 98 has a lower preload force than spring 99, spring 99 will not compress and shaft 81 will be pushed to the left and shroud 92 will remain in contact with head 89 until cam follower 77 makes contact with cam 27 which through leg 69 and cradle 65 will stop shaft 81 from moving or until the force on spring 98 equals the force on spring 99. Then spring 99 will compress and shroud 92 will move off head 89. If spring 98 has a higher preload force than spring 99, spring 99 will compress allowing shroud 92 to move off head 89 and continue until the force of spring 99 equals the preload of spring 98 at which time they would both compress allowing shaft 81 to move to the left moving cradle 65 as well. If both springs have the same preload force, the movement of shaft 81 and the shroud 92 off head 89 would occur simultaneously. Regardless of the preload spring forces, shaft 81 causes movement of cradle assembly 65 which moves cam follower 77 affixed to leg 69 to make contact with cam 27. The movement of the cradle assembly 65 also moves valve control spool 32 so that fluid can now flow from pressure port 50 through annulus 59 into chamber 57 and on to bore 62 into chamber 24, best shown in FIG. 3. At the same time, chamber 25 has a fluid flow path through bore 63 to chamber 56 to annulus 58 through bore 55 to return pressure port 51. This spool displacement and fluid pressure therefore causes a differential force to now exist across vane 19 which now will start a clockwise rotation, as noted in FIG. 6, provided the torsional resistive load on shaft 18 is not in excess of the available torque. The force of the solenoid 82 through pin 96, springs 98 or 99, shaft 81 and cradle assembly 65 will keep cam follower 77 in contact with cam 27. As shaft 18 (an integral part of vane 19) starts to rotate, it will now move spool 32 to the right by the force of the cam 27 against cam follower 77 and leg 69 causing cradle assembly 65 and shaft 81 to move by overcoming forces caused by the effective spring 98 or 99. Regardless of the initial preload force on either spring 98 or 99, as the shaft starts to move to the right, spring 98 will expand and spring 99 will compress allowing a greater clearance between shroud 92 and head 89 until spool 32 is centered again, as shown in FIG. 7. Head 89 will never contact disc 94 and will always have clearance between them, as shown. As this mechanical feedback of the spool 32 occurs, the porting area of cylinder 35 in annulus 59 and cylinder 34 in annulus 58 is now reducing and the available fluid flow subsequently reduces the velocity of shaft 18 which has now been rotated to a position in excess of 180° but less than 360° from its starting point as seen in FIG. 6 and FIG. 7. However, it can be seen that by changing the position of the cam 27 on the shaft that the final position is infinitely variable less the angular movement lost due to the overtravel stop 17 and thickness of the vane 19. During this same movement, it can easily be seen that the return fluid flow path is also valved off by cylinder 34 cooperating with annulus 58 providing a degenerative pressure/force response. The final position is as shown in FIG. 7. The available torsional force from the shaft 18 and cam 27 combination to move the cradle assembly 65 is greater than the forces created by spring 98 and 99. The force developed by spring 99 is not as great as that which is developed by solenoid 82 and therefore shroud 92 maintains its position. The system as shown in FIG. 7 is now at rest with spool 32 centered and cylinder 35 in mid-position with annulus 59. The shaft has rotated to its maximum clockwise position and is stopped. As long as solenoid 82 remains energized, the system will remain as per FIG. 7.

Upon de-energization of solenoid 82, the disc 94 and shroud 92 will be pushed by springs 98 and 99 toward solenoid stop 97. As the shroud 92 moves, it engages cap 89; spring 99 will be fully expanded and spring 98 will cause sufficient force to overcome any friction in the system and pull shaft 81 and hence cradle assembly 65 until cam follower 76 attached to leg 68 of cradle assembly 65 is in contact with cam 26. If for some reason the cam follower 76 and cam 26 do not make contact first, solenoid stop 97 will prevent continued travel of the shaft 81 and cradle assembly 65 to prevent damage to solenoid 82. An adjusting means consisting of screw 93 and wavy washer 95 allows for mechanical adjustment and centering of the valve spool 32 in cradle 65 to balance the cams 26 and 27 with cam followers 76 and 77. The mechanical connections between cradle assembly 65 and spool 32 moves the spool to the right which now opens the four-way valve of cylinder 35 and annulus 59 porting fluid from bore 50 through annulus 59 into chamber 56 through bore 63 into vane chamber 25. The output flow is from vane chamber 24 through bore 62 through chamber 57 into annulus 60 and bore 52 through 53 to cross bore 54 to exit into return port 51. The pressure difference across vane 19 causes an imbalance in force which now causes shaft 18 to rotate counterclockwise thereby effecting work. The interaction of the cam 26 position on the shaft will react in a similar manner as described before and the cradle assembly 65 will push spool 32 to the left closing off the valving action. The completion of this cycle will move the vane 19, spool 32 and spring shaft 81 to the position shown in FIG. 5.

The cams 26 and 27 can be infinitely adjustable for a balanced rotation of shaft 18 or it can be offset having a greater rotation in one direction than the other. This adjustment means is by a saw-cut 29 on cam 27 and screw 28 shown in FIG. 1. An identical adjustment means is also on cam 26. The contact surface of cam 26 between cam 26 and follower 76 or between surface of cam 27 and follower 77 can be contoured to give variable velocity and acceleration to each direction of movement. The adjustability of the cams allows any rotational position desired to be achieved at any desired velocity or acceleration. The solenoid can be cyclically energized and the rotation and speed of operation would be a function of the spring-mass natural frequency of the system. In general, the response of the system will be governed by the load characteristic with the rotor device contributing little to reduce the overall performance. The speed of the system operation can be increased by increasing the fluid pressure applied to the system and, conversely, can be slowed by decreasing fluid pressure. The preferred way to improve speed performance would be to increase the stroke or movement of the valve spool 32 which would allow a greater fluid flow through the system.

It can also be realized that the solenoid assembly could be replaced by a mechanical linkage and spring means as shown in FIG. 9 which would be loaded to a center position that could control the movement of the valve spool mechanically and achieve rotation of the vane. A single or plurality of spring means may be used in this method to achieve the appropriate operation. The mechanical control of valve spool 32 and cradle 65 could be accomplished by means shown in FIG. 9 consisting of plunger 102 biased in base 100 by spring 104.

The plunger 102 is affixed to cradle 65 by pin 108 and its movement is restrained in base 100 by snap ring 107. Movement of the plunger 102 to the left in FIG. 9 would cause the same effect as energizing the solenoid 82 in FIG. 6. As long as the plunger is held to the left, the same sequence of events will occur as described earlier; that is, the offset of spool 32 will port fluid to one side of vane 19 and cause it to move.

Figure 8:
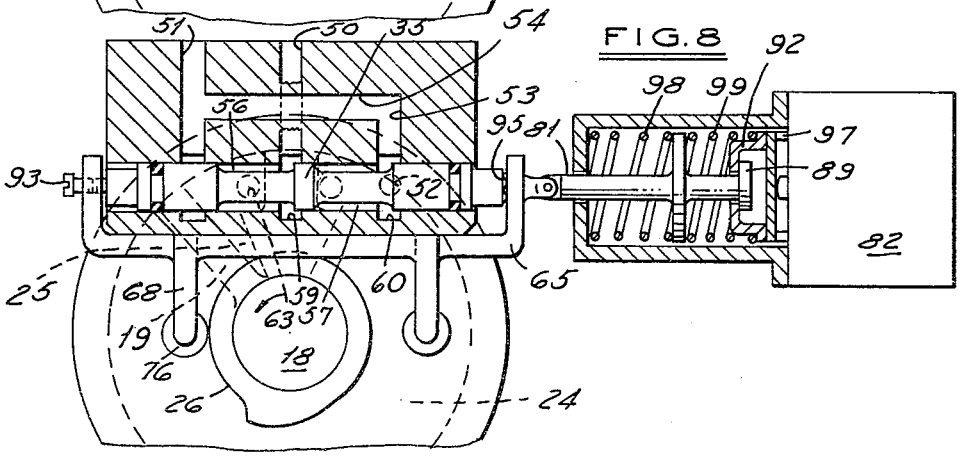
FIG. 8 is a partial section showing the solenoid deenergized and spool off center at start of a return cycle.

Releasing plunger 102 will move spool 32 to the right as shown in FIG. 8 and a similar sequence to de-energizing solenoid 82 will occur with regard to the movement of vane 19 and spool 32.

Another feature is that impulses on the shaft would be dampened by a feedback scheme since the spool would move to counteract the torque (impulse). Also, the spring restoring forces in the system, although small, give an additional damping characteristic.

It can readily be seen that a single cam arrangement and spring means can be used which would allow for movement to one position and, upon release, it would return to its original position. Also, by mechanical control, the position of the rotating shaft can be stopped and held in any desired position by moving back to the center position on the valve spool, thereby giving an infinite number of rotational positions for the vane shaft assembly.

This invention has been described with preference given to this embodiment. No doubt one skilled in this art will see modifications upon reading and understanding this specification and it is my intention to include all such modifications insofar as they come into the scope of the appended claims.

Having thus described my invention, I claim:

1. A fluid operated reciprocating rotary actuator with less than 360° rotation having an integral vane and shaft in combination with a control valve providing a degenerative pressure/force response connected to a solenoid assembly comprising:

a. a cam means affixed to said actuator shaft,
b. a cam follower means engaging said cam means,
c. a structure means holding said cam follower means against said cam means, and said structure means connected directly to both ends of said control valve means and to said solenoid assembly means effecting feedback between said cam means, said valve means and said solenoid means,
d. an electrical solenoid affixedly held in a housing means and plunger means operatively moveable by energizing and de-energizing said solenoid means,
e. a shaft means controlled by said plunger means,
f. spring housing means affixed to said solenoid housing means,
g. spring retaining means, and
h. spring means within said spring housing means cooperating with said shaft means, said spring housing means and said spring retaining means.

2. The combination as claimed in claim 1 wherein said spring means comprises two preloaded springs used in conjunction with said shaft means and said spring retaining means within said spring housing means wherein a first spring is disposed between said shaft means and said spring housing means and a second spring is disposed between said shaft means and said spring retaining means.

3. The combination as claimed in claim 2 wherein the spring constant of said springs are equal.

4. The combination as claimed in claim 2 wherein the spring constant of said first spring is greater than the spring constant of said second spring.

5. The combination as claimed in claim 2 wherein the spring constant of said first spring is less than the spring constant of said second spring.

6. A fluid operated bidirectional rotary actuator having an integral vane and shaft in combination with a four way control valve spool comprising:

a. an adjustable cam means affixed to the said actuator shaft,
b. a cam follower means for engaging said cam means, and
c. a cradle means including a u-shaped section and two legs, said legs straddling the cam means and being secured to the follower means, said U-shaped section including surfaces which are in direct engagement with the ends of the valve spool such that a feedback connection is effected between the cam means and the valve spool.

7. The combination as claimed in claim 6 wherein said valve spool and said cradle means are controlled by a solenoid assembly means.

8. The combination as claimed in claim 7 wherein said solenoid assembly means is affixed to said cradle means wherein said solenoid assembly means comprises:

a. an electrical solenoid and plunger means,
b. a spring positioned shaft means controlled by said plunger means,
c. spring housing means affixed to said solenoid means,
d. spring retaining means, and
e. spring means within said housing means.

9. The combination as claimed in claim 6 wherein said valve spool is adjustably affixed to said cradle means.

* * * * *